US010037755B2

(12) United States Patent
Kwan

(10) Patent No.: US 10,037,755 B2
(45) Date of Patent: Jul. 31, 2018

(54) METHOD AND SYSTEM FOR ACTIVE NOISE REDUCTION

(71) Applicant: Signal Processing, Inc., Rockville, MD (US)

(72) Inventor: Chiman Kwan, Rockville, MD (US)

( * ) Notice: Subject to any disclaimer, the term of this patent is extended or adjusted under 35 U.S.C. 154(b) by 0 days.

(21) Appl. No.: 15/361,126

(22) Filed: Nov. 25, 2016

(65) Prior Publication Data

US 2018/0151171 A1 May 31, 2018

(51) Int. Cl.
*G10K 11/16* (2006.01)
*H04R 3/00* (2006.01)
(Continued)

(52) U.S. Cl.
CPC ..... *G10K 11/178* (2013.01); *G10K 11/1784* (2013.01); *H04R 1/323* (2013.01); *G10K 2210/109* (2013.01); *G10K 2210/3028* (2013.01); *G10K 2210/3044* (2013.01); *G10K 2210/3045* (2013.01)

(58) Field of Classification Search
CPC ..... G10K 11/178; G10K 11/1782; G10K 11/1784; G10K 11/1788; G10K 2210/12; G10K 2210/105; G10K 2210/108; G10K 2210/1081; G10K 2210/3025; G10K 2210/3027; G10K 2210/3028; G10K 2210/30232; G10K 2210/109; G10K 2210/3044; G10K 2210/3045; H04R 2460/01; H04R 2499/13; H04R 2227/001; H04R 25/407; H04R 3/00; H04R 3/005; H04R 3/02; H04R 3/04; H04R 1/323; F24F 13/24; F24F 2013/247
See application file for complete search history.

(56) References Cited

U.S. PATENT DOCUMENTS 5,337,366 A * 8/1994 Eguchi ..... G10K 11/1784 381/71.11
9,117,457 B2 8/2015 Kwan
(Continued)

OTHER PUBLICATIONS

S. M. Kuo et al., Design of Active Noise Control Systems With the TMS320 Family, 1996.
(Continued)

*Primary Examiner* — Thang Tran
(74) *Attorney, Agent, or Firm* — IP-R-US, LLC; Peter S. Wong

(57) ABSTRACT

An active noise reduction system and method to cancel fan or blower noise. The system utilizes 2 microphones: one to pick up the subject noise and the noisy signal at far field. The proposed system utilizes a portable loudspeaker that is placed near the subject. The loudspeaker broadcasts omni-directional or directional anti-phase signals to reduce the noise at far field. The system includes a real-time processor (DSP or FPGA) with fast adaptive filter to process the 2 microphone signals and generate the anti-phase signal. The adaptive filter uses the second microphone as a reference to generate an out-of-phase signal, which can then suppress the far field noise. The system is simple to set up and portable. The system utilizes frequency-domain adaptive filter and proven algorithms to quickly compute the anti-phase signals for cancelling detected noise.

9 Claims, 11 Drawing Sheets

Frequency domain FXLMS with band selection.

(51) Int. Cl.
*G10K 11/178* (2006.01)
*H04R 1/32* (2006.01)

(56) References Cited

U.S. PATENT DOCUMENTS

| | | | | |
|---|---|---|---|---|
| 2010/0014685 | A1* | 1/2010 | Wurm | G10K 11/178 381/71.11 |
| 2010/0172511 | A1* | 7/2010 | Togawa | G10K 11/1782 381/71.11 |
| 2016/0163304 | A1* | 6/2016 | Lee | G10K 11/178 381/71.4 |
| 2016/0163305 | A1* | 6/2016 | Lee | G10K 11/178 381/71.4 |
| 2016/0372106 | A1* | 12/2016 | Hanazono | F24F 13/24 |
| 2017/0276398 | A1* | 9/2017 | Hanazono | F24F 13/24 |

OTHER PUBLICATIONS

S. M. Kuo and D. R. Morgan, Active Noise Control: A Tutorial, Proceedings of the IEEE, vol. 87, No. 6, Jun. 1999.

C. Kwan, J. Zhou, J. Qiao, G. Liu, and B. Ayhan, "A High Performance Approach to Local Active Noise Reduction," IEEE Conference on Decision and Control, Las Vegas, Dec. 2016.

J. Zhou, B. Ayhan, C. Kwan, and O. S. Sands, "A High Performance Approach to Minimizing Interactions between Inbound and Outbound Signals in Helmet," SPIE Conference on Defense, Security, and Applications, Baltimore, 2012.

* cited by examiner

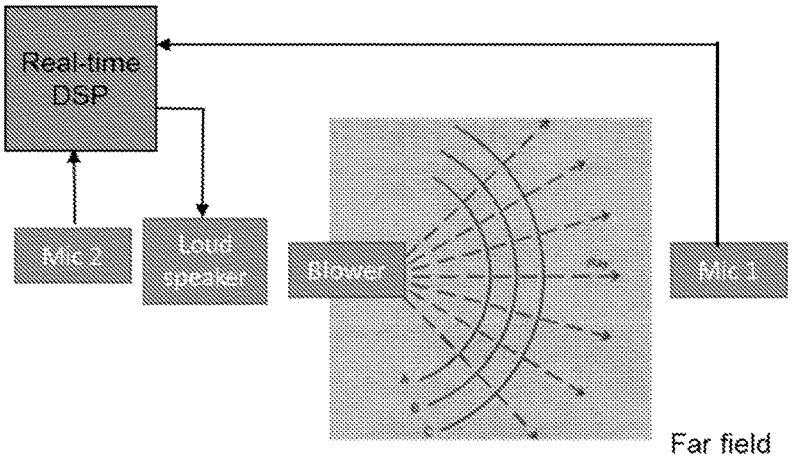
Fig. 1: Concept of active noise reduction. The system uses 2 mics, 1 omni-directional loud speaker, and a real-time processor.
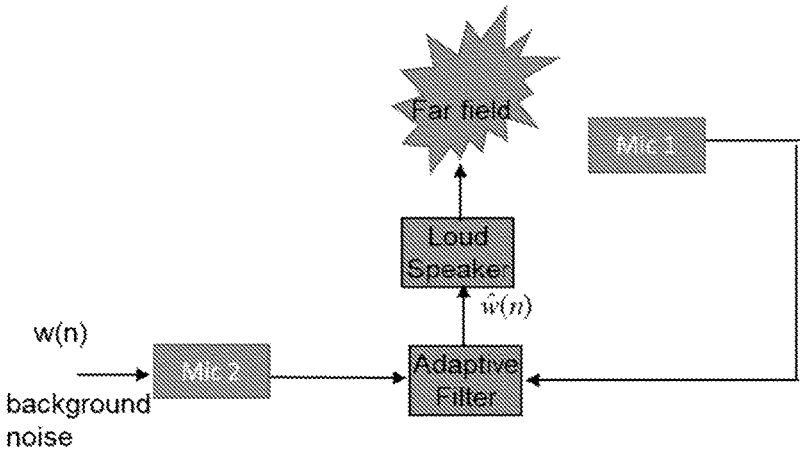
Fig. 3: Adaptive filter to reduce fan noise at far field. Background noise, also known as reference, refers to the fan noise from mic 2.

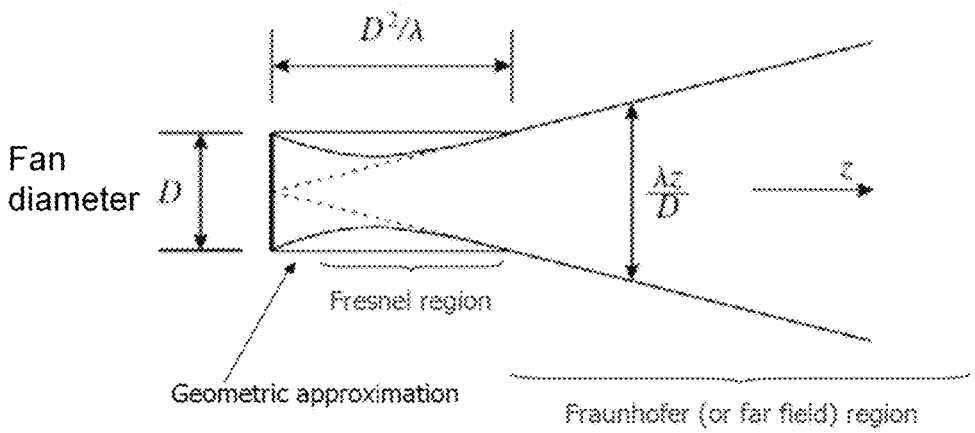
Fig. 2 Relationship of fan diameter and wavelength with near field and far field.

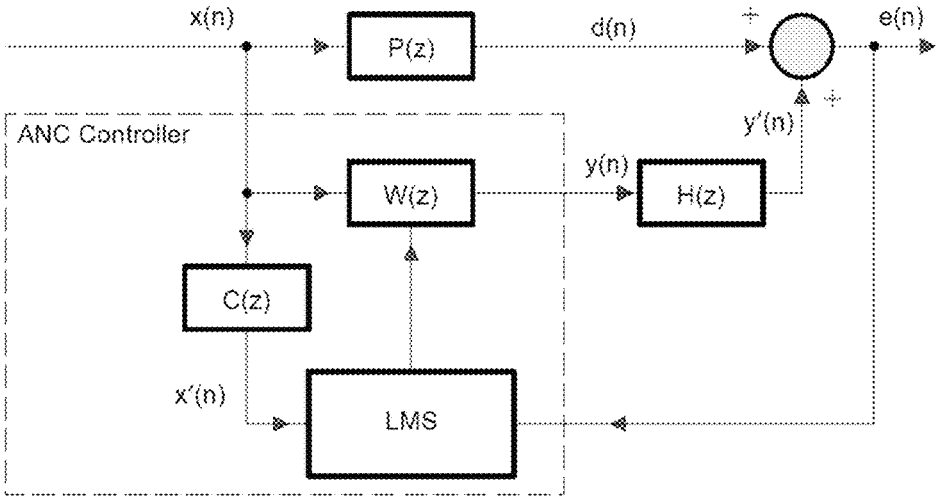
Fig. 4: Active noise control system configuration.

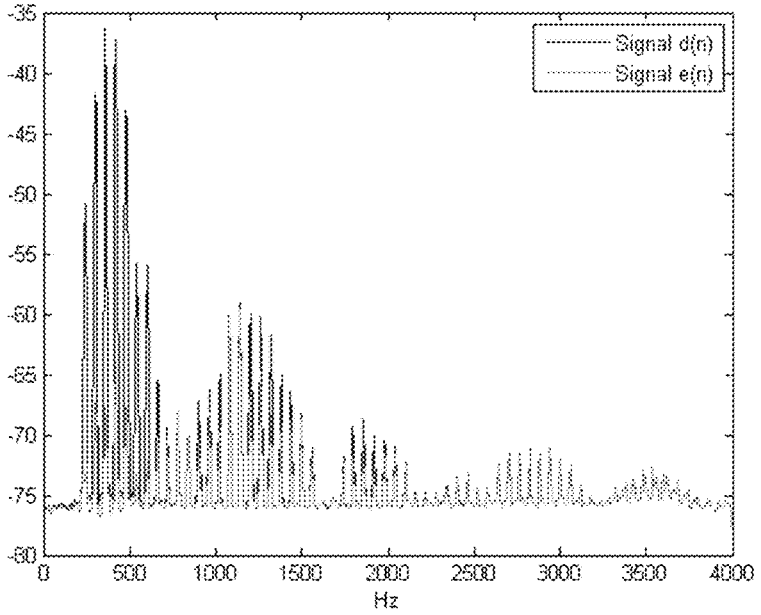
Fig. 5(a) Frequency spectrum before, signal d(n), and after filtering, signal e(n).
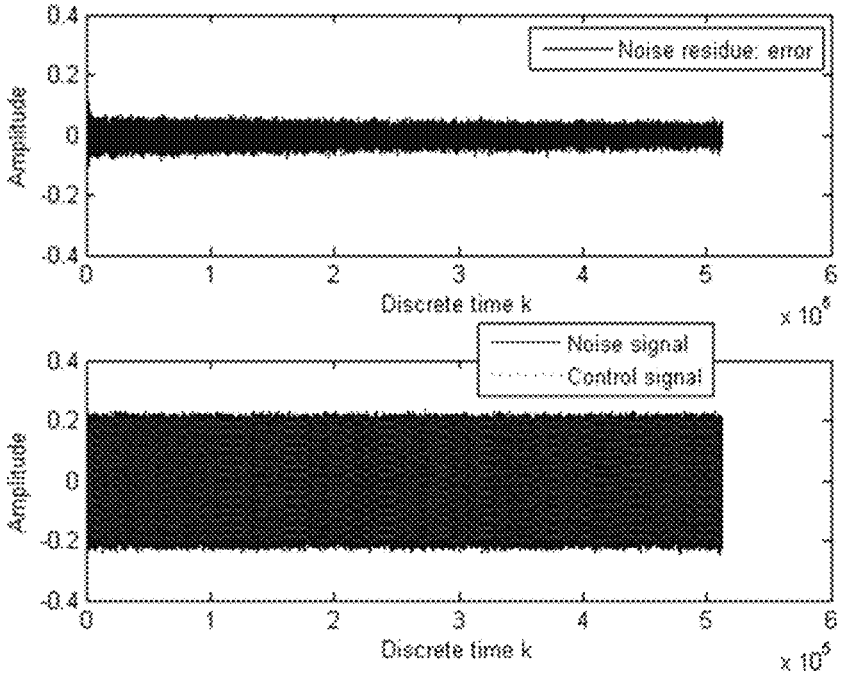
Fig. 5(b) Noise residue, noise, and control signals.

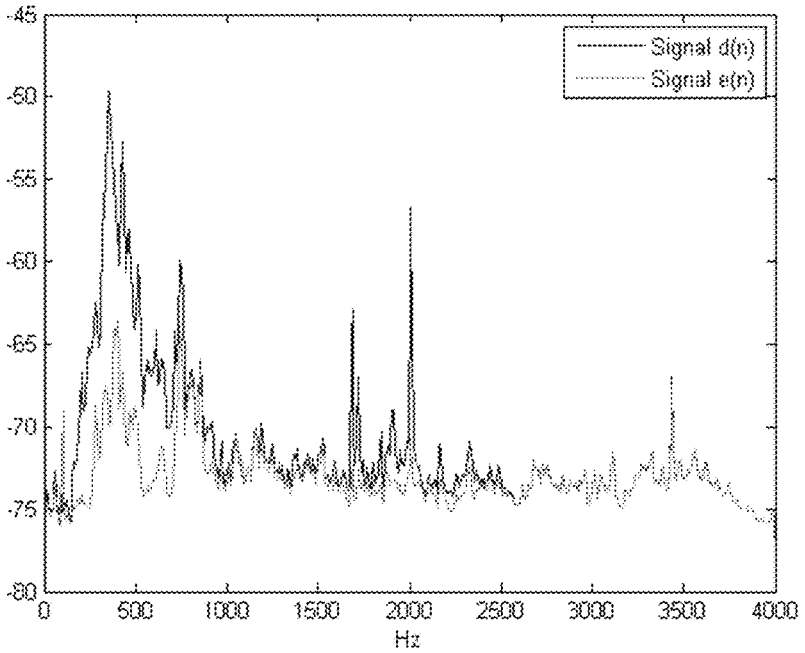
Fig. 6(a) Frequency spectrum before, signal d(n), and after filtering, signal e(n).
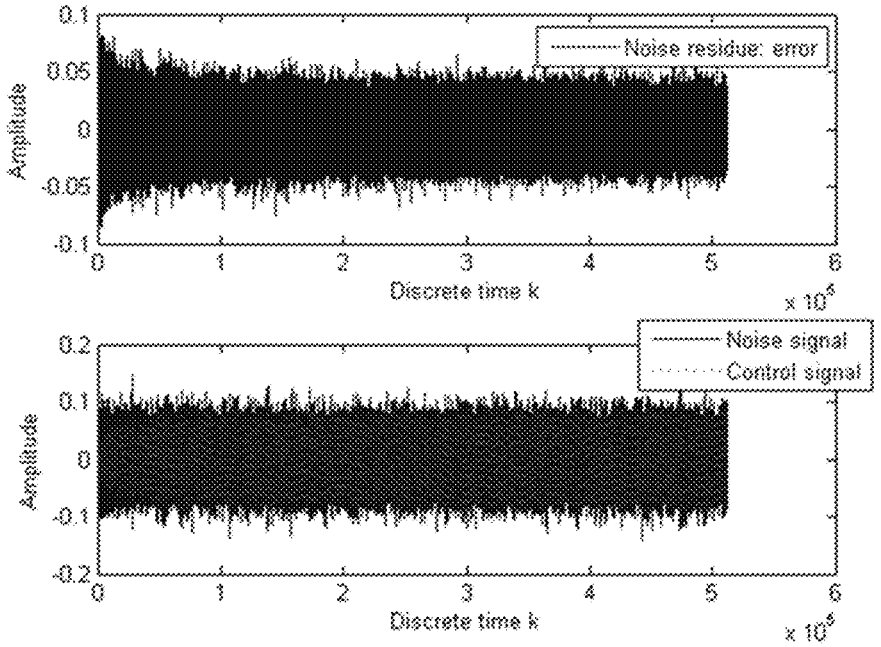
Fig. 6(b) Noise residue, noise, and control signals.

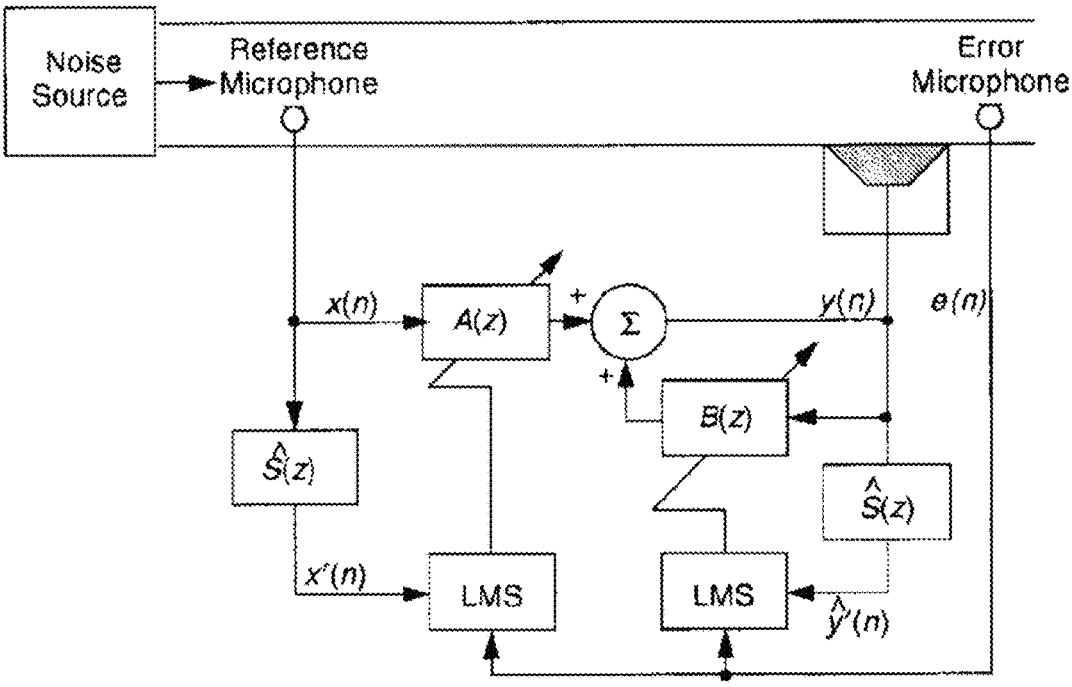
Fig. 7: ANC system using the filtered-U recursive LMS algorithm

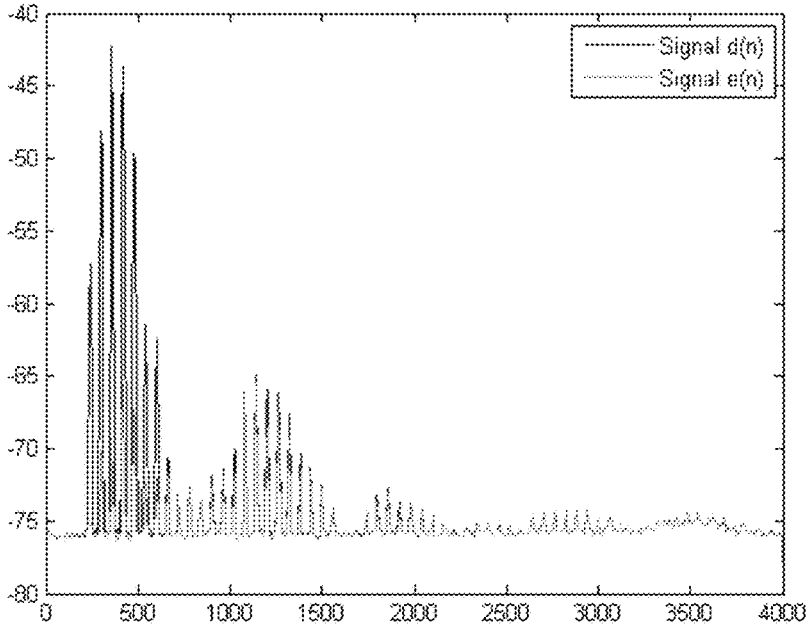
Fig. 8(a) Frequency spectrum before, signal d(n), and after filtering, signal e(n).
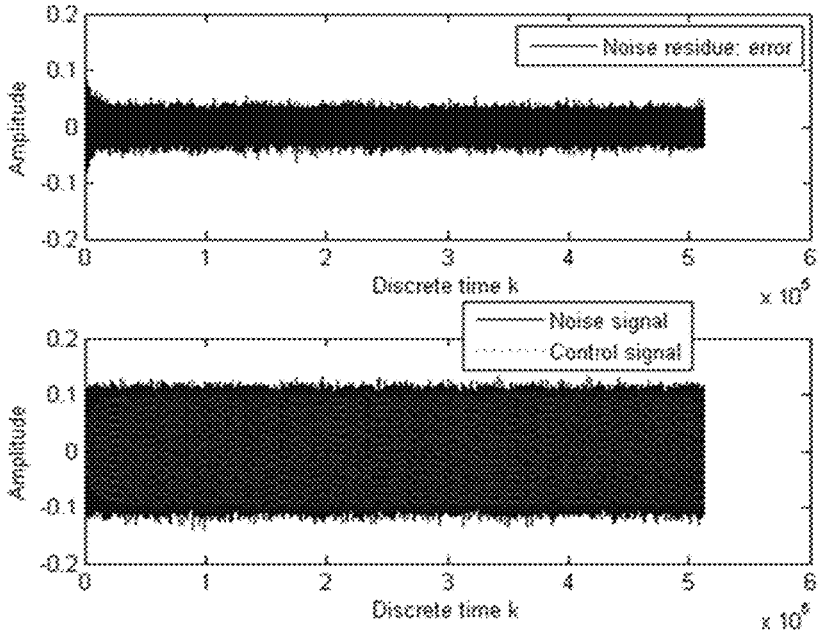
Fig. 8(b) Noise residue, noise, and control signals.

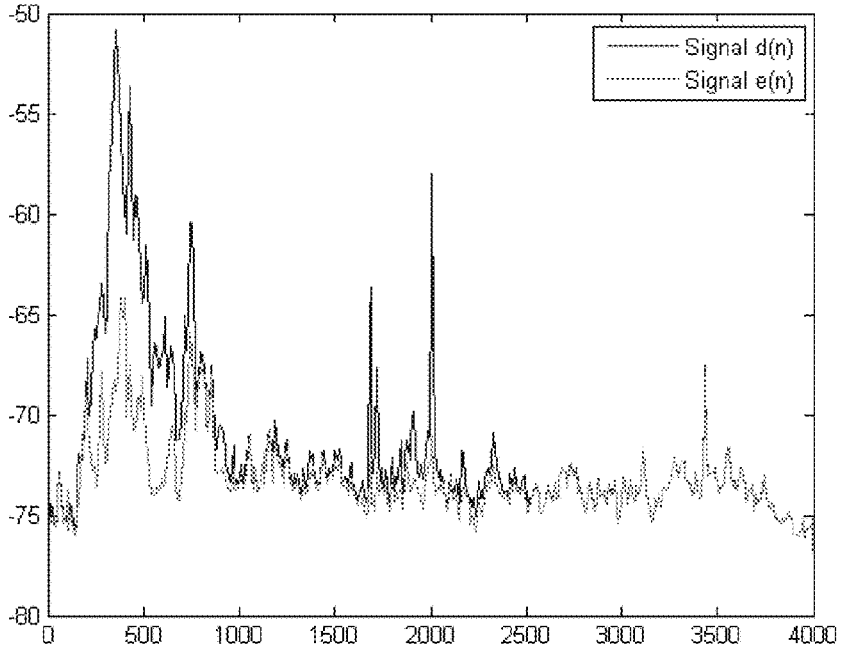
Fig. 9(a) Frequency spectrum before, signal d(n), and after filtering, signal e(n).
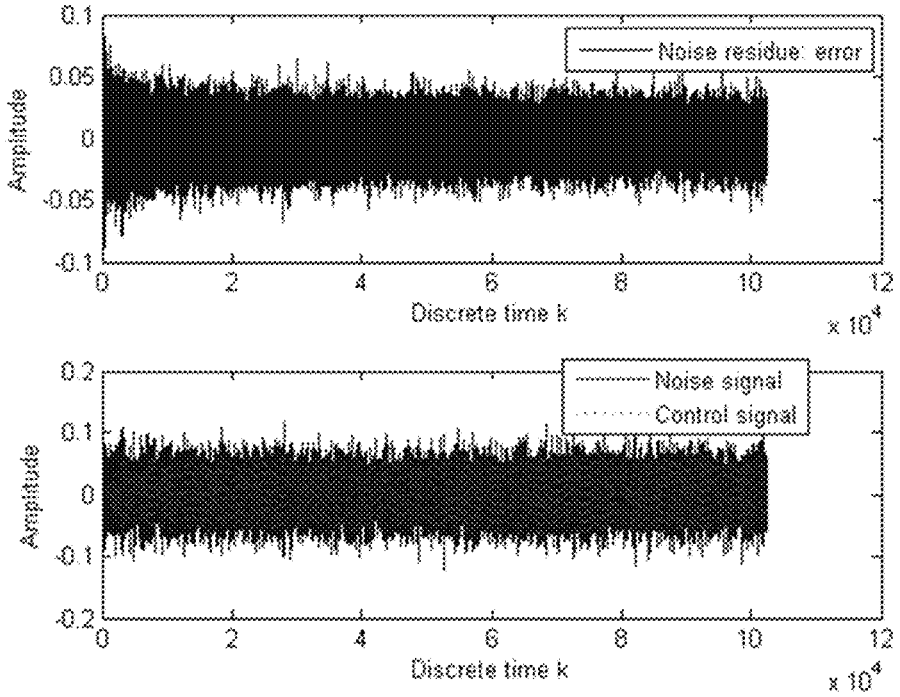
Fig. 9(b) Noise residue, noise, and control signals.

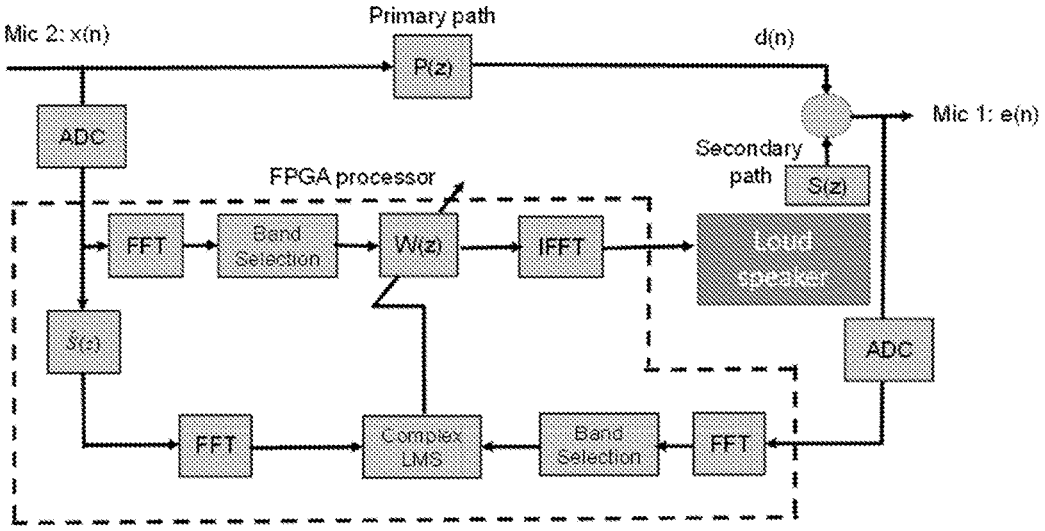
Fig. 10: Frequency domain FXLMS with band selection.

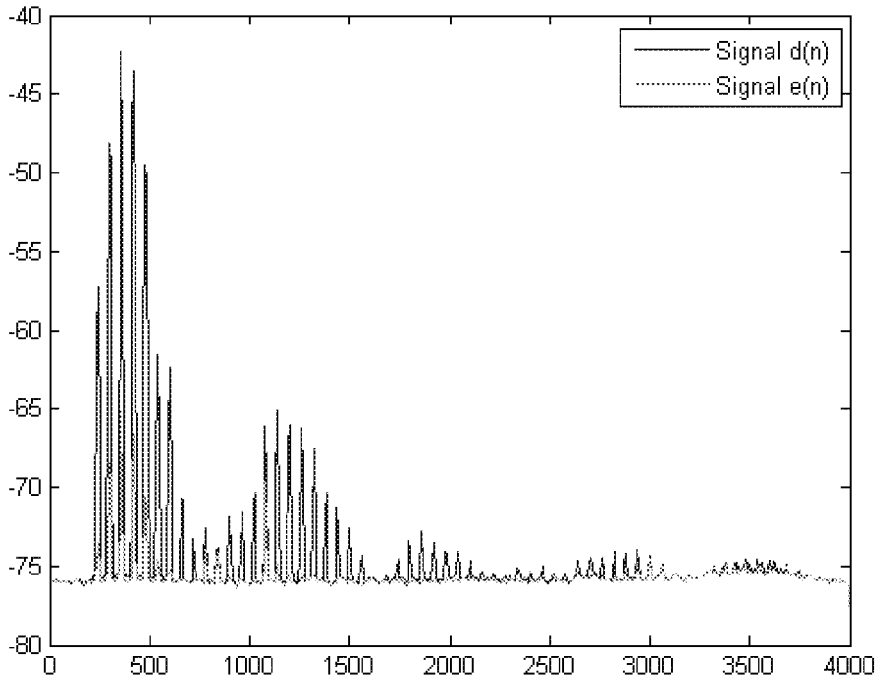
Fig. 11(a) Frequency spectrum before, signal d(n), and after filtering, signal e(n).
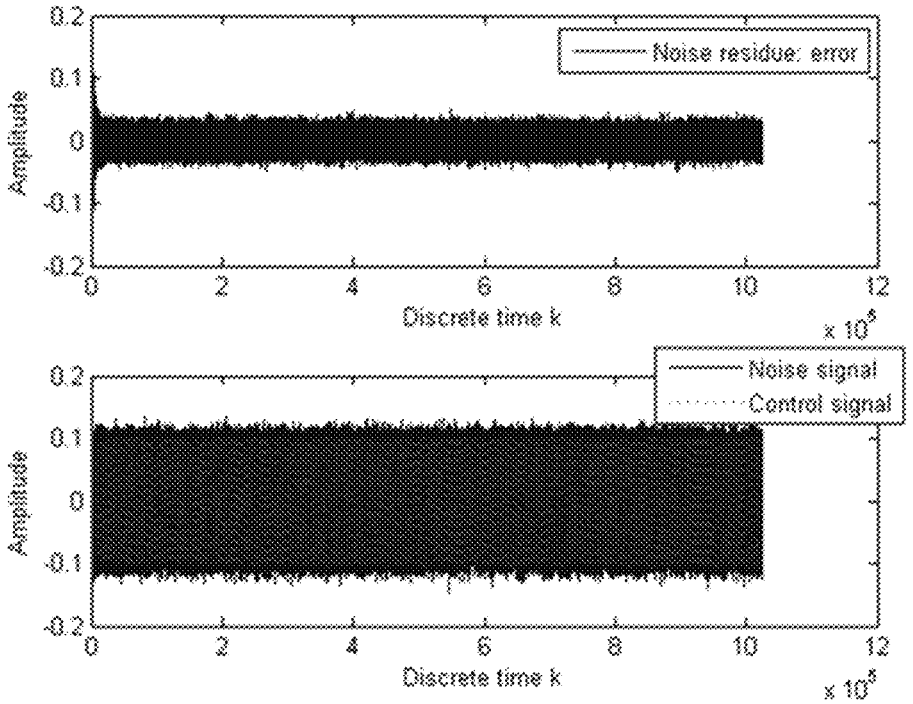
Fig. 11(b) Noise residue, noise, and control signals.

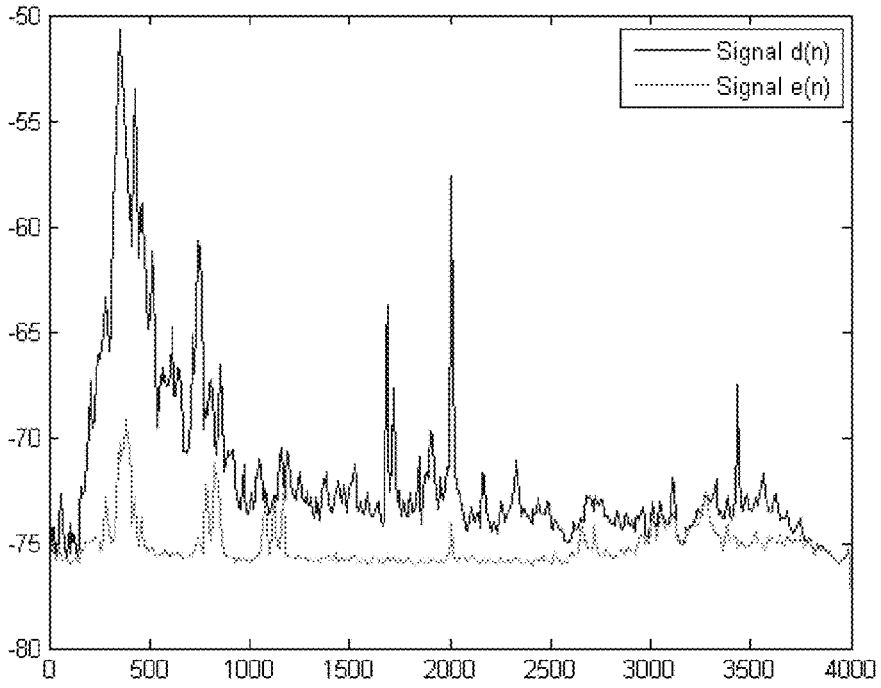
Fig. 12(a) Frequency spectrum before, signal d(n), and after filtering, signal e(n).
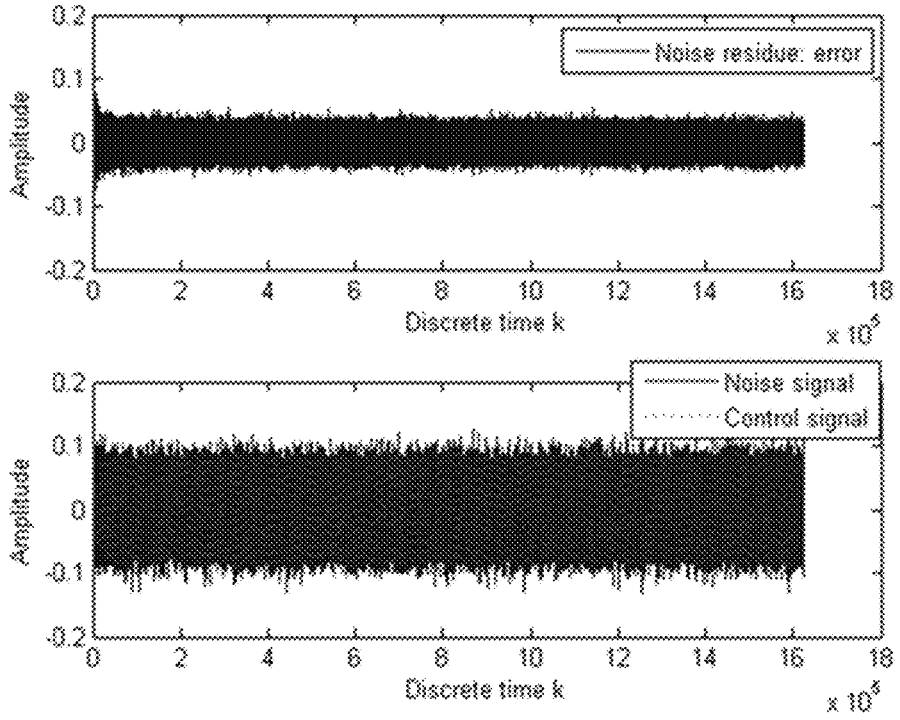
Fig. 12(b) Noise residue, noise, and control signals.

METHOD AND SYSTEM FOR ACTIVE NOISE REDUCTION

BACKGROUND OF THE INVENTION

Fans and blowers are used in many applications. For example, they have been used for blowing hot air away from power generators to cool down the generators. In some situations, the noise created by the fans or blowers can be very annoying to engineers working nearby. It is well known that long term exposure to noisy environment may have negative impact to people's hearing. Moreover, people tend to get tired more easily in noisy environment.

1. Past Approaches to Fan Noise Reduction

There are some approaches to fan noise reduction. Some of them require a redesign of the fans. Others have been proven to only work for computers. All of them may not be directly applicable to legacy fans or blowers in civilian and military systems. An ideal solution should be a low cost and portable active noise cancellation system that can be used in many diverse scenarios. The near field behavior of fan noise is complicated. However, at far field, the fan noise pattern is regular, which is similar to a spherical wave. The far field is defined as the square of the fan diameter divided by the sound wavelength. For a fan having a diameter of 1 ft., the distance to far field is about 1 ft. for a frequency of 1 kHz. One challenge is that the fan noise may consist of a band of frequencies, making it harder to suppress even at far field.

One prior active noise reduction system is disclosed in U.S. Pat. No. 9,117,457, issued on Aug. 25, 2015, by C. Kwan and J. Zhou, "Compact Plug-In Noise Cancellation Device," which is useful for speech enhancement of cell phones and stethoscopes, but not as efficient when applied to fan noise reduction.

2. Proposed Active Noise Reduction Approach

The present invention proposes a novel and high-performance system to cancel fan or blower noise. The goal is to significantly reduce the noise at far field, which is more than 0.3 meter (1 ft.) for a fan size of 1 ft. in diameter and a noise frequency of 1 kHz. First, the present invention proposes to utilize 2 microphones: one to pick up the fan noise and the other one to pick up the noisy signal at far field. Second, the present invention proposes a portable loudspeaker that can be easily placed near the fan. The loudspeaker broadcasts omni-directional anti-phase signals to reduce the noise at far field. The present invention should perform well as the loudspeaker and the fan will look like point sources from the far field. Third, a real-time Digital Signal Processor (DSP) or Field Programmable Gate Array (FPGA) with fast adaptive filter is used to process the 2 microphone signals and generate the anti-phase signal. The adaptive filter uses the second microphone (fan noise) as a reference to generate an out-of-phase signal, which can then suppress the far field noise.

The key advantages of the present invention are briefly summarized as follows:

Simple setup and portable. The second microphone is placed in a small hardware box which contains the digital signal processor. This microphone should only pick up the fan noise. It should be placed close to the fan. The loudspeaker is compact and low cost (see FIG. 1). The loudspeaker should be placed very close to the fan so that both the loudspeaker and the fan will appear to be from the same point source from the far field. The whole system is portable.

High performance active noise suppression. The present invention is achieved by the fact that fan noise and the anti-phase signal from the loudspeaker look like spherical waves coming from the same point source far field. As a result, the two signals will cancel each other if the phase of the signal from the loudspeaker is adjusted appropriately.

Proven algorithms in noisy environments. The present invention utilizes proven adaptive algorithms to quickly compute the anti-phase signals.

Details of the proposed system and software algorithm will be described below.

BRIEF DESCRIPTION OF THE DRAWINGS

FIG. 1 illustrates the concept of active noise reduction. The system of the present invention uses 2 microphones, 1 omni-directional loudspeaker, and a real-time processor.

FIG. 2 illustrates the relationship of fan diameter and wavelength with near field and far field.

FIG. 3 illustrates using an adaptive filter to reduce fan noise at far field. Background noise, also known as reference, refers to the fan noise from microphone 2.

FIG. 4 illustrates an active noise control system configuration.

FIG. 5(*a*) illustrates the frequency spectrum before, signal d(n), and after filtering, signal e(n).

FIG. 5(*b*) illustrates the noise residue, noise, and control signals. The control signal and noise amplitudes are close.

FIG. 6(*a*) illustrates the frequency spectrum before, signal d(n); and after filtering, signal e(n).

FIG. 6(*b*) illustrates the noise residue, noise, and control signals. The control signal and noise amplitudes are close.

FIG. 7 illustrates an ANC system using the filtered-U recursive Least Mean Square (LMS) algorithm.

FIG. 8(*a*) illustrates a frequency spectrum before, signal d(n); and after filtering, signal e(n).

FIG. 8(*b*) illustrates the noise residue, noise, and control signals. The control signal and noise amplitudes are close.

FIG. 9(*a*) illustrates the frequency spectrum before, signal d(n); and after filtering, signal e(n).

FIG. 9(*b*) illustrates the noise residue, noise, and control signals. The control signal and noise amplitudes are close.

FIG. 10 illustrates the frequency domain Filtered X-Least Mean Square (FX-LMS) with band selection.

FIG. 11(*a*) illustrates the frequency spectrum before, signal d(n); and after filtering, signal e(n).

FIG. 11(*b*) illustrates the noise residue, noise, and control signals. The control signal and noise amplitudes are close.

FIG. 12(*a*) illustrates the frequency spectrum before, signal d(n); and after filtering, signal e(n).

FIG. 12(*b*) illustrates the noise residue, noise, and control signals. The control signal and noise amplitudes are close.

SUMMARY OF THE INVENTION

One embodiment of the present invention is to provide a portable system, which can effectively reduce fan or blower noise at far field.

Another embodiment of the present invention is to perform active noise reduction without modifying the fans and blowers.

Another embodiment of the present invention is to use a loudspeaker to generate anti-phase signals which can cancel the fan/blower noise at far field. The loudspeaker should be placed near the fan/blower so that both the loudspeaker and the fan will become a point source from far field.

Another embodiment of the present invention is to use two microphones. One for picking up the noise at far field, and the other one for picking up fan noise near the fan.

Another embodiment of the present invention is that the active noise reduction algorithms can be implemented in a Digital Signal Processor (DSP) and a Field Programmable Gate Array (FPGA).

DETAILED DESCRIPTION OF THE INVENTION

Overall Active Noise Reduction System Architecture

As shown in FIG. 1, the present invention proposes an intelligent and high performance active noise reduction system, which can suppress far field noise. There are several components in our system. First, besides using a microphone at far field, another microphone will be used to pick up the fan noise. This second microphone can reside in a hardware box which contains the DSP. The key for microphone 2 is to pick up the fan noise only. Some microphones can fulfill this purpose by only picking up near field signals. Second, a loudspeaker will be used to produce a sound field (180 deg. out of phase signal to cancel background noise). The loudspeaker should be placed very close to the fan (see FIG. 1). Third, the present invention utilizes a dual microphone adaptive filtering algorithm to generate anti-phase signals to reduce the background noise.

Active Noise Reduction at Far Field

As shown in FIG. 2, the sound field from a fan source can be divided into near field and far field. Far field sound pattern is more regular. Depending on the sound field of the fan, the present invention either uses omnidirectional or more directional speakers. If the fan noise pattern is directional, then a directional speaker should be more appropriate in order to minimize noise spillover.

Mathematically, the far field condition is related to the size of the fan (D), wavelength of sound (λ), and distance (z) by $$z >> \frac{D^2}{\lambda}.$$

Assuming a sound speed of 300 m/s and a fan diameter of 0.3 meter, the values of $D^2/\lambda$ will be 0.15 meter for f=500 Hz, 0.3 meter for f=1,000 Hz, and 0.6 meter for f=2,000 Hz. So, at 1 meter away, the sound field will be uniform and hence it should be easier to suppress.

Real-Time Adaptive Noise Reduction Algorithm

The signal flow in a typical active noise reduction system is shown in FIG. 3. Two microphones and one loudspeaker are required. Microphone 1 measures the error signal in far field and the signals in Microphone 1 should be as small as possible. Microphone 2 picks up some reference/fan signals that are different from Microphone 1. Finally, both microphones will be used to generate some anti-phase signals that will be played in the loudspeaker to nullify the fan noise.

The following paragraphs summarize the principle of three adaptive algorithms and simulation results. It should be noted that the simulation results were for a different application scenario where a small quiet zone is created by active noise cancellation. Although the application scenario is different from fan noise reduction, the simulations clearly demonstrate the performance of the adaptive algorithms and is adaptable to fan noise reduction.

A. Filtered X-LMS

In active noise control (see FIG. 4), the goal is to make the error mic output e(n) as small as possible. Due to the presence of the secondary path (H(z)), conventional feedback control algorithms and feedforward LMS algorithm do not perform well. A Filtered X-Least Mean Square (FX-LMS) algorithm was used to compensate for the effects of H(z), as disclosed in the articles by, S. M. Kuo et al., "Design of Active Noise Control Systems with the TMS320 Family," 1996; and C. Kwan, J. Zhou, J. Qiao, G. Liu, and B. Ayhan, "A High Performance Approach to Local Active Noise Reduction," IEEE Conference on Decision and Control, December 2016.

The FX-LMS algorithm can be summarized as follows:

1. Input the reference signal x(n) from the Mic 2 and the error signal e(n) from Microphone 1, all from the input ports;
2. Compute the anti-noise y(n);
3. Output the anti-noise y(n) to the output port to drive the canceling loudspeaker;
4. Compute the filtered X version of x'(n);
5. Update the coefficients of adaptive filter W(z); and
6. Repeat the procedure for the next iteration.

Note that the total number of memory locations required for this algorithm is 2(N+M) plus some parameters.

The FX-LMS is implemented by performing extensive simulation studies. The following parameters are used: filter learning rate=0.01, frame size=512, and sampling rate 8 kHz. The narrowband results are shown in FIG. 5 and the broadband results are shown in FIG. 6. The average noise attenuation for the two cases are:

Attenuation=15.91 dB for narrow band signal

Attenuation=7.65 dB for NASA noise file which contains actual noise in the International Space Station.

B. Filtered U-LMS

In practice, the control signal from the loudspeaker may be picked up by the reference mic and a positive feedback loop may occur. To avoid the positive feedback, a Filtered U-LMS (FU-LMS) algorithm was proposed in an article by, S. M. Kuo and D. R. Morgan, "Active Noise Control: A Tutorial," Proc. of the IEEE, Vol. 87, No. 6, June 1999. FIG. 7 shows the block diagram of FU-LMS algorithm.

The FU-LMS as shown in FIG. 7 can be summarized as follows:

a. Input the reference signal x(n) and the error signal e(n) from the input ports;

b. Compute the anti-noise y(n);

c. Output the anti-noise y(n) to the output port to drive the canceling loudspeaker;

d. Perform the filtered U operation;

e. Update the coefficients of the adaptive filters A(z) and B(z); and f. Repeat the algorithm for the next iteration.

The following parameters were used: adaptation rate=0.01, frame size=512, and sampling rate 8 kHz. The narrowband results are shown in FIG. 8 and the broadband results are shown in FIG. 9. The average noise attenuation for the two cases are:

Attenuation=14.41 dB for narrow band signal

Attenuation=6.93 dB for NASA noise file

C. FD-FX-LMS-BS

The present invention utilizes a frequency-domain adaptive filter (FD-FX-LMS-BS) as shown in the dotted block in FIG. 10. Mic 1 measures the reference noise, denoted as e(n), in an area of interest. P(z) and S(z) denote the transfer functions of the primary and secondary paths respectively. $\hat{S}(z)$ is the estimated transfer function of the secondary path. The estimation of $\hat{S}(z)$ can be done off-line. Mic 2 measures the background or primary noise, denoted as x(n). There are two Analog to Digital Converters (ADC) that digitize the two microphones outputs. The ADC outputs of the primary (Mic 2) and reference signals (Mic 1) are then transformed into the frequency domain using the Fast Fourier Transform (FFT) and processes these signals by an adaptive filter, denoted by W(z). The filter outputs will be converted to time-domain signals via an Inverse Fast Fourier transform (IFFT). A loudspeaker is used to broadcast the anti-phase signals, IFFT outputs, to cancel the primary path output d(n) near Mic 1. A band selection block is used to select single tones, narrow bands, or even broadband signals for suppression. The block "Complex LMS" is a LMS algorithm working in the complex number domain because the FFT outputs are complex numbers. This frequency domain technique saves computations, replacing the time-domain linear convolution by multiplication in the frequency domain. For each frequency component, there is a parameter for adaptive adjustment. This is a key advantage in the frequency domain approach of the present invention. Based on evaluations, the FD-FX-LMS-BS approach performs better than the time domain FX-LMS approach. As shown in FIG. 10, the algorithm of the present invention can be implemented in a Field Programmable Gate Array (FPGA) processor for real-time execution.

The Narrowband results are shown in FIG. 11, and the Broadband results are shown in FIG. 12. The average noise attenuation for the two mentioned cases are:

Attenuation=14.36 dB for narrow band signal

Attenuation=10.21 dB for NASA file

It will be apparent to those skilled in the art that various modifications and variations can be made to the system and method of the present disclosure without departing from the scope or spirit of the disclosure. It should be perceived that the illustrated embodiments are only preferred examples of describing the invention and should not be taken as limiting the scope of the invention.

The invention claimed is:

1. A portable active noise cancellation system comprising:

a first microphone for picking up noisy signal at a far field;

a second microphone for picking up the noisy signal from a subject;

a portable loudspeaker placed near the subject; and a real-time digital signal processor with a frequency-domain adaptive filter receiving the noisy signals from the first and second microphones, generating snit-phase signals by using the frequency-domain adaptive filter, and supplying the anti-phase signals to the portable loudspeaker; wherein, the frequency-domain adaptive filter including:

Fast Fourier Transform (FET) modules configured to transform the received noise signals into frequency domains;

Frequency band selectors configured to select, from the frequency domains, the noisy signal frequencies of a single tone, narrow band and broadbands; and an adaptive filter to generate the anti-phase signals based on the selected results.

2. A portable active noise cancellation system in accordance to claim 1, wherein:

the loudspeaker broadcasts omni-directional or directional anti-phase signals to reduce the noisy signal, as the loudspeaker and the subject appear as a single point source from the far field.

3. A portable active noise cancellation system in accordance to claim 2, wherein:

the second microphone is placed close to the subject, picking up the noisy signal from the subject.

4. A portable active noise cancellation system in accordance to claim 3, wherein:

the second microphone is placed in a hardware box containing the real-time digital signal processor.

5. A portable active noise cancellation system in accordance to claim 2, wherein:

the far field is more than 1 ft. from the subject having a diameter of at least 1 ft., and a noise frequency of about 1 kHz.

6. A portable active noise cancellation system in accordance to claim 2, wherein:

the noisy signal and the anti-phase signal from the portable loudspeaker appear as spherical waves coming from the same point source at the far field.

7. A method of active noise cancellation of a subject, comprising the steps of:

a. receiving a reference signal x(n) from a first microphone at a far field;

b. receiving an error signal e(n) from a second microphone from a subject;

c. transforming the error and reference signals into frequency domain using a real-time digital signal processor with Fast Fourier Transform (FFT);

d. selecting, from the frequency domain, the bandwidth frequencies of the error and reference signals of a single tone, narrow band and broadband;

e. processing signals selected from the selecting step by an adaptive filter to generate an anti-phase noise cancelling signal; and f. outputting the anti-phase noise cancelling signal through a loudspeaker.

8. A method of active noise cancellation of a subject in accordance to claim 7, further comprising the steps of:

a. placing the second microphone close to the subject;

b. picking up the noisy signal from the subject; and c. placing the second microphone is in a hardware box containing a Digital Signal Processor (DSP) or Field Programmable Gate Array (FPGA).

9. A method of active noise cancellation of a subject in accordance to claim 7, wherein the adaptive filter is a Frequency-Domain Filtered X-Least Mean Square adaptive filter (FD-FX-LMS-BS).

* * * * *